United States Patent [19]

Wilson

[11] Patent Number: 4,971,578

[45] Date of Patent: Nov. 20, 1990

[54] ELECTRICAL CONNECTOR

[75] Inventor: Ronald A. Wilson, Medway, Mass.

[73] Assignee: Microwave Development Laboratories, Inc., Needham, Mass.

[21] Appl. No.: 398,154

[22] Filed: Aug. 24, 1989

Related U.S. Application Data

[63] Continuation-in-part of Ser. No. 248,601, Sep. 26, 1988, Pat. No. 4,920,643.

[51] Int. Cl.[5] ..... H01R 17/18

[52] U.S. Cl. ..... 439/578

[58] Field of Search ..... 439/578–585

[56] References Cited

U.S. PATENT DOCUMENTS

| | | | |
|---|---|---|---|
| 3,292,117 | 12/1966 | Bryant et al. | 439/578 |
| 3,336,563 | 8/1967 | Hyslop | 439/578 |
| 4,799,902 | 1/1989 | Laudig et al. | 439/578 |

*Primary Examiner*—Joseph H. McGlynn

*Attorney, Agent, or Firm*—Wolf, Greenfield & Sacks

[57] ABSTRACT

An electrical connector having inner and outer conductors along with an insulating sleeve therebetween. The inner conductor has three recesses disposed therealong including a middle recess and oppositely disposed remote recesses. A pair of spaced rings are disposed respectively between the middle recess and remote recesses. The rings each are of a diameter greater than the middle recess diameter and are dimensioned so that the connector is well-matched over a broad frequency band.

20 Claims, 2 Drawing Sheets

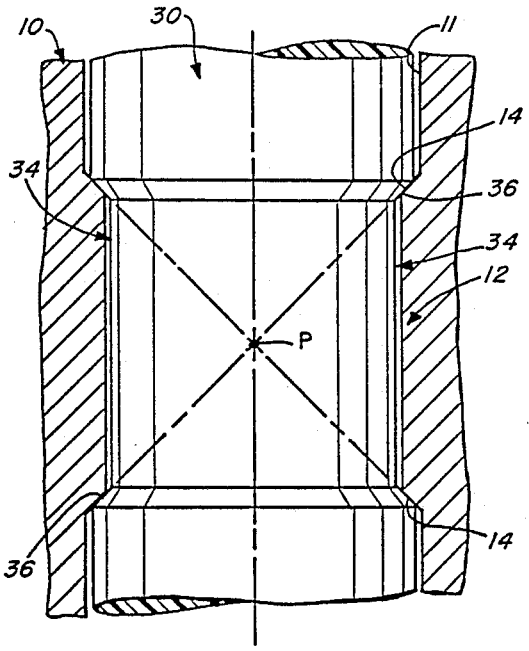
Fig. 1
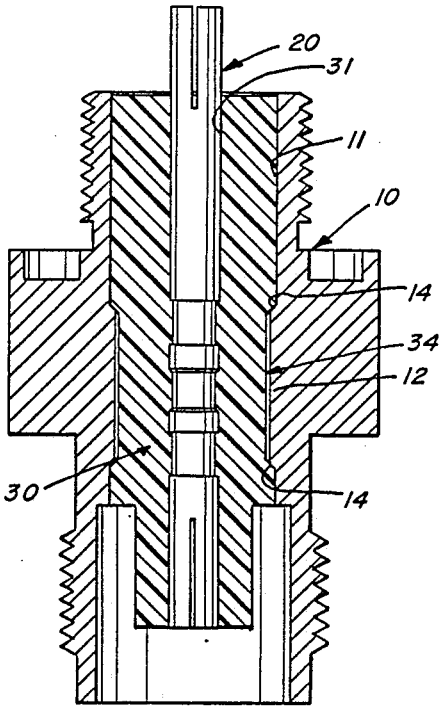
Fig. 3 Fig. 2
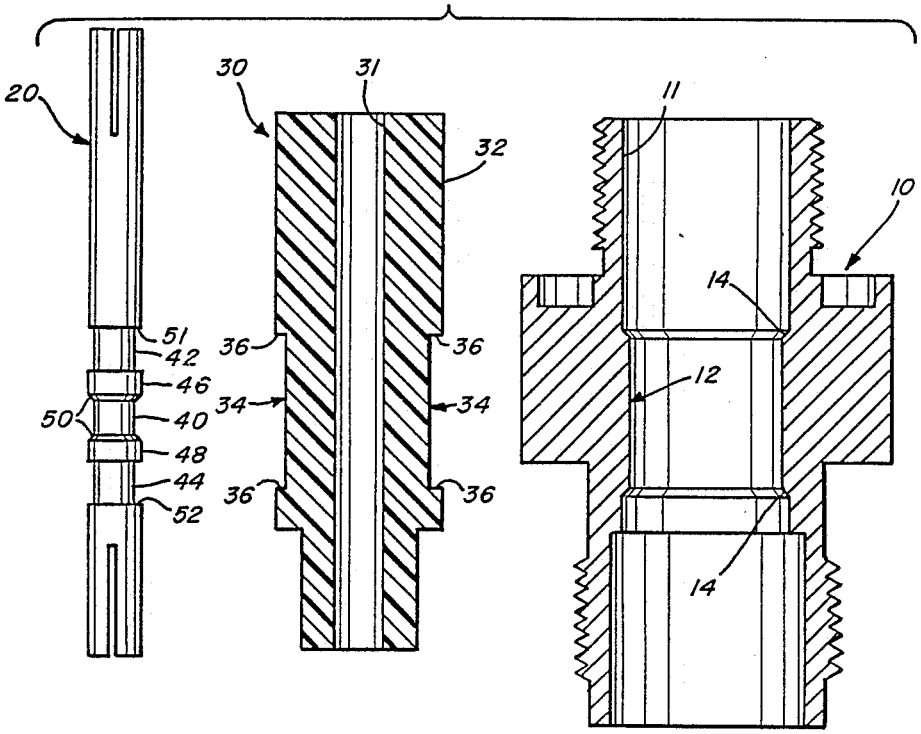

ELECTRICAL CONNECTOR

RELATED APPLICATIONS

The present invention is considered to be a continuation-in-part of application Ser. No. 07/248,601 filed on Sept. 6, 1988, now Pat. No. 4,920,643 . Both of the above-identified related applications are hereby incorporated-by-reference herein.

The following are related applications pertaining to electrical connectors and the method of assembly thereof:

| Title | Pat. No. | Filing Date |
|---|---|---|
| Electrical Connector | 4,907,983 | 4/20/88 |
| Electrical Connector | 4,920,643 | 9/26/88 |

BACKGROUND OF THE INVENTION

1. Field of the Invention

The present invention relates in general to an electrical connector which may be of the jack-to-jack or barrel connector type including a center conductor and outer conductor and with these conductors separated by an insulating sleeve. More particularly, the present invention relates to an improved construction for the inner conductor of such a connector so as to both maintain mechanical integrity as well as to provide proper electrical match.

2. Background Discussion and Objects of the Invention

My aforementioned U.S. application Ser. No. 07/183,974 filed on Apr. 20, 1988 describes an improved electrical connector construction in which the connector is characterized by having an improved mechanically tight seal and in which the connector inner and outer conductor parts are maintained in a rigid mechanical interconnecting relationship. This prior application describes a connector that is comprised of an outer conductor connector body having a center bore with there being defined in this center bore an inwardly directed annular ridge extending into the bore. A sleeve is provided in the outer conductor body bore and is adapted to be mated substantially therewith and including means forming an annular recess that interlocks with the annular ridge. An inner conductor is adapted to fit within the sleeve. In accordance with the improvement in U.S. Ser. No. 07/183,974, the outer conductor in particular is maintained with mechanical integrity and over a wide temperature range. To accomplish this, the annular ridge has at opposite sides thereof end walls transitioning between the outer conductor body bore and the annular ridge. The annular recess has at opposite sides thereof recess-defining end walls transitioning between the outer diameter of the sleeve and the inner diameter of the sleeve at said annular recess. At least segments of the end walls of both the ridge and recess are in contact. The end walls of both the ridge and recess define a circumferential surface. The circumferential surfaces on at least one side of the ridge and recess are formed as a frusto-conic surface of a cone. The circumferential surfaces on both sides of the ridge and recess converge in a direction so as to project to a common point.

My co-pending application Ser. No. 07/248,601 filed on Sept. 26, 1988 describes an improved method of assembly of an electrical connector to provide mechanical tightness particularly over an extended temperature range. This application describes a particular construction for an inner conductor of the connector. The present application now describes further details of the inner conductor as it relates both to mechanical integrity as well as electrical impedance matching.

Accordingly, it is an object of the present invention to provide an improved electrical connector and one which in particular has an improved construction for the inner conductor.

Another object of the present invention is to provide an improved coaxial-type electrical connector in which the electrical connector is characterized by having an improved mechanically tight seal, particularly over relatively wide temperature ranges.

A further object of the present invention is to provide an improved coaxial type electrical connector in which the inner conductor is constructed for mechanical integrity and tightness as well as for electrical performance.

SUMMARY OF THE INVENTION

To accomplish the foregoing and other objects, features and advantages of the invention, there is now described herein an improved coaxial electrical connector. The electrical connector is comprised of an outer conductor, an inner conductor and an insulating sleeve member. The insulating sleeve member provides electrical isolation between the inner and outer conductors. The inner conductor has means defined therein that are disposed axially therealong forming three successive recesses on its outer surface including a middle recess and oppositely remote recesses essentially on either side of the middle recess. A pair of spaced annular ring-like sections rings are defined disposed respectively between the middle recess and the remote recesses. The ring-like sections are each of a diameter greater than the middle recess diameter and dimensioned so that the connector is well matched over a broad frequency band.

In accordance with the present invention, there are also a number of other features relating to the construction of the inner conductor. The diameter of the middle recess is preferably less than the remote recesses. Each recess is usually in the form of an annular groove in the inner conductor. The diameters of the remote recesses in the disclosed embodiment herein are the same. The aforementioned ring-like sections, preferably each have an axial length less than the axial length of the middle recess.

In accordance with a further aspect of the present invention, the outer conductor has means for an interlocking with the insulating member including a constricting ridge of the outer conductor in combination with a recess in the insulating member. The outer conductor ridge as well as the inner conductor remote recesses all have transitioning walls at the axial ends thereof. In accordance with one feature of the present invention for enhancing electrical performance, the transitioning walls at opposite ends of the inner conductor recesses are disposed axially and spacedly outside of the transitioning walls of the outer conductor. In the embodiment disclosed herein, the transitioning walls of the outer conductor ridge are tapered and likewise the transitioning walls of the inner conductor middle recess are tapered. The tapered transitioning walls of the inner conductor middle recess extend to a common point so as to optimize interlocking over a significant temperature range. In an embodiment disclosed herein, both the inner and outer conductor tapered transitioning walls all extend to a common point. However, in alternate embodiments, the respective inner and outer transitioning walls may extend to separate common points.

BRIEF DESCRIPTION OF THE DRAWINGS

Numerous other objects, features and advantages of the invention should now become apparent upon a reading of the following detailed description taken in conjunction with the accompanying drawings, in which:

FIG. 1 is a fragmentary illustrative view of a portion of the connector of the present invention illustrating the interlocking relationship between the outer conductor and the insulating sleeve;

FIG. 2 is a cross-sectional view of an assembled connector as in accordance with the present invention, illustrating in particular the outer conductor body, the inner conductor and the insulating sleeve;

FIG. 3 is an exploded view of the three basic components of the connector including the improved inner connector construction.

DETAIL DESCRIPTION

Figure 4:
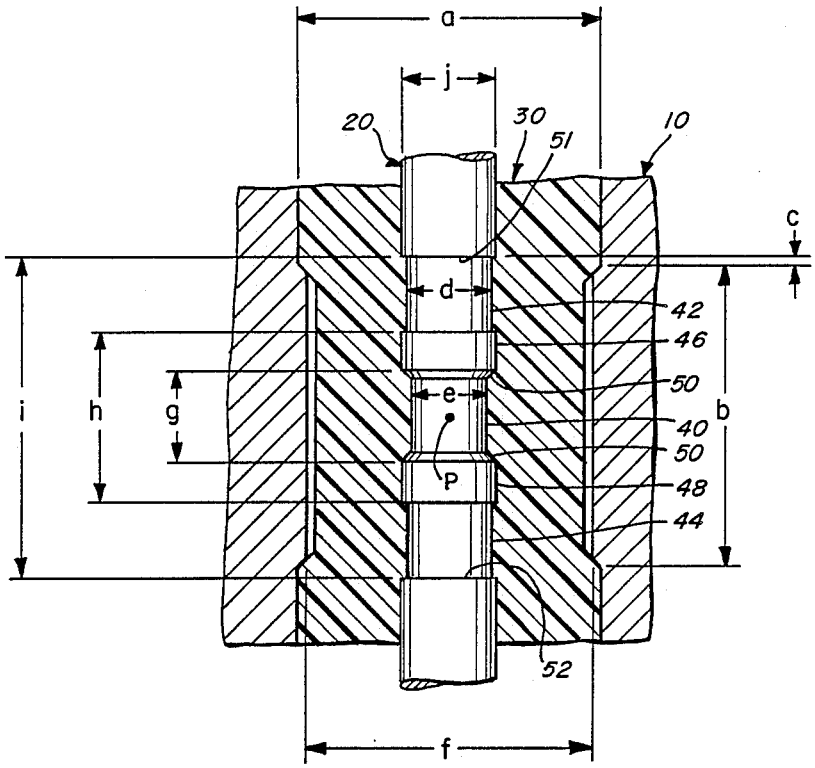
FIG. 4 is a somewhat enlarged view of relationships between the construction and relative positioning of the inner and outer conductors, particularly important dimensions of the inner conductor.

In accordance with the present invention, there is provided an improved construction for the inner conductor, identified in the drawings as inner conductor or center conductor 20. It is preferred to machine this inner conductor from relatively standard stock that is cylindrical in shape. In accordance with the invention, there has been developed an inner conductor that has proper mechanical integrity so as to maintain interlocking of the inner conductor with the insulating sleeve over a wide temperature range while at the same time providing proper electrical matching between the inner and outer conductors. Hereinafter, there are developed further details of the construction of the inner conductor as it relates to the aforementioned aspects.

With particular reference to FIGS. 1 and 2, there is shown a connector constructed in accordance with the present invention. This connector is of the coaxial type and includes an outer conductor body 10, an inner conductor 20 and an insulating sleeve 30. The principles of the present invention may be employed in connection with the making of any type of a connector in which inner and outer connectors are to be relatively supported. In FIG. 2 the inner conductor 20 and the outer conductor body 10 may be constructed of standard metal material. The insulating sleeve 30 is preferably a Teflon sleeve. Teflon has good cold flow properties, but in addition, the Teflon sleeve also has a "memory" which means that it will tend to revert back to a normal "rest" position after being deformed. It is this "memory" characteristic of the Teflon sleeve that is taken advantage of in accordance with the invention described in application Ser. No. 07/248,601 filed on Sept 26, 1988.

FIG. 3 is an exploded view illustrating the components of the connector as considered in their "at rest" state. In this regard, it is noted that the outer conductor body 10 has an inner bore 11 with an inwardly directed substantially annular ridge 12 extending therefrom. The ridge 12 is defined at its ends by respective beveled end walls 14 that transition from the ridge 12 to the bore 11. For an enlarged view of the ridge 12 and beveled end walls 14, refer to the enlarged fragmentary view of FIG. 1 herein.

Now, with reference to FIG. 3, there is also illustrated the insulating sleeve 30 which, as indicated previously, is preferably of a Teflon material. The sleeve 30 has an inner bore 31 that is adapted to accommodate the inner conductor 20, to be described hereinafter. The sleeve 30 also has defined in its outer surface 32, an annular recess 34. The recess 34 is defined by end walls 36 which in the preferred embodiment are not beveled, but are instead disposed at a 90 degree angle as is illustrated in FIG. 3. The length of the recess 34 between the walls 36 is selected so that when the components are in their assembled position, such as is illustrated in FIG. 2, the walls 36 deform and essentially match the configuration of the beveled walls 14 of the rigid outer conductor body. In this regard, refer to FIG. 1 herein.

As just indicated, the distance between the walls 36 is selected so that the walls become depressed and match the configuration of the beveled walls 14 of the outer conductor body. In this regard, the distance between the walls 36 is preferably about the same as the distance between the mid-points along the restrictive beveled walls 14.

FIGS. 2 and 4 herein illustrate the position of the center conductor and furthermore illustrate the configuration thereof, basically having three separate recesses identified in FIG. 4 as recesses 40, 42, and 44. The recess 40 is a middle recess and the recesses 42 and 44 are considered to be oppositely disposed remote recesses. FIG. 4 also shows a pair of annular ring-like sections, hereinafter referred to as rings 46 and 48. The ring 46 is disposed between the recesses 40 and 42 and the ring 48 is disposed between the recesses 40 and 44. Each of these recesses have transitioning walls at the ends thereof such as the tapered walls 50 illustrated in FIG. 4. The frusto-conic transitioning walls 50 extend between the recess 40 and the respective rings 46 and 48. Similar transitioning walls also are associated with the recesses 40 and 44. These transitioning walls are right-angle walls as noted in FIG. 4.

Now, with reference to FIG. 1 herein, this is illustrated for the purpose of showing primarily the interrelationship between the insulating sleeve and the outer conductor. This connector configuration is constructed in accordance with the principles as described in my earlier co-pending application Ser. No. 07/183,974 filed on Apr. 20, 1988 and incorporated by reference herein. This prior application illustrates ridge and recess configurations for both symmetric and asymmetric connector configurations. In both symmetric and asymmetric configurations, it is noted that the beveled walls converge to a common point illustrated in FIG. 1 as the point "P" which actually is the vertex of mirror-image cones. Thus, the beveled walls 14 in FIG. 1 are actually frusto conic surfaces that all converge to a common point "P". With this arrangement, as described in my earlier co-pending applications, mechanical tight fitness is maintained even over wide temperature ranges over which the connector is expected to operate. Thus, the wall surfaces of the respective outer conductor and sleeve are maintained in contact by virtue of these principles with at least one of the wall surfaces of the respective body and sleeve being defined as a frusto-conic surface of a cone with the wall surfaces projectionable to a common vertex. Again, this common vertex in the embodiment of FIG. 1 is shown at the point "P".

Now, with reference to FIG. 4, it is noted that there is also illustrated therein substantially the same point "P". It is noted that the transitioning walls 50 associated with the recess 40 likewise converge to point "P". This, thus, also provides the same type of temperature compensation as it relates to the mechanical type interlocking between the insulating sleeve 30 and the inner conductor 20.

Now, in accordance with the present invention and as particularly illustrated in FIG. 4 herein, the inner conductor construction consists of three properly shaped recesses that yield a well-matched coaxial connector in spite of the fact that the inner conductor has to be configured so as to be firmly fixed with the insulator, preferably over relatively wide temperature ranges.

A center recess or groove 40 is provided preferably with tapered or chamfered ends 50 to provide the aforementioned temperature compensation as it relates to the insulating sleeve and inner conductor. The depth of the recess 40 has been determined in one example so as to be sufficiently deep to withstand a pre-determined pin insertion force. Per connector specifications, a certain type of SMA-style connector has to withstand a maximum pin insertion force of three pounds and a minimum push-out force of six pounds. With an undercut as illustrated in FIG. 4 with dimensions to be described hereinafter, the parts did not move at a pin insertion force of twelve pounds. Accordingly, these dimensions have been shown to be more than acceptable from the standpoint of mechanical tight interlocking.

With regard to the dimensions of the connector, we now provide the following table correlating to the connector of FIG. 4 showing various dimensions that are important in connection with the connector and in particular the center conductor thereof. The following dimensions set forth in the table are based upon an experimental connector having a normalized diameter of 1.000 inch. These dimensions are, thus, substantially larger than those of a typical SMA connector. For SMA connectors, these dimensions would have to be substantially scaled down.

TABLE ONE

| Dimension | Magnitude |
|---|---|
| a | 1.000 in. |
| b | 1.000 in. |
| c | 0.030 in. |
| d | 0.278 in. |
| e | 0.246 in. |
| f | 0.909 in. |
| g | 0.306 in. |
| h | 0.560 in. |
| i | 1.060 in |
| j | 0.306 in. |

As far as electrical performance is concerned, because of the provision for changes in diameter of the conductors for interlocking purposes, there are attendant electrical mismatches that may occur. For example, the reduction in the inner diameter of the outer conductor will lower the impedance of the connector to an unacceptable degree unless the diameter of the inner conductor is also reduced sufficiently. Accordingly, there is a corresponding reduction in the diameter of the inner conductor, as illustrated at the transition walls 51 and 52 in FIG. 4. It is known that the impedance of a coaxial line varies logrithmically with the ratio of the diameter of the outer conductor to the diameter of the inner conductor. Because there is a transition, as far as the outer conductor is concerned from a diameter of 1.000 (Dimension "a") to a diameter of 0.909 (Dimension "f"), this means that there is a similar change in the inner conductor diameters from 0.306 (Dimension "j") to 0.278 (Dimension "d").

There is also a reflection established whenever there is an abrupt change in diameter even though the same impedance is maintained on both sides of the change, since such a change is found at the tapered end walls where the insulator and outer conductor contact each other. Although this type of a transition has been analyzed by A Kraus in *Journal of British IRE,* of Feb. 1960 starting at page 137, there is no description therein about the case for a tapered transition. By experimentation the change in diameter of the inner conductor at transition walls 51 and 52 has been found to be best placed from a matching standpoint outside of the outer conductor tapered transition. The result is that the ends of the reduction in the diameter of the inner conductor are placed outside of the tapered ends of the recess in the outer conductor in such a way as to provide shunt inductances which substantially compensates for the shunt capacitance introduced by the tapers at the ends of the recess in the outer conductor.

After experimentation, a gap dimension has been found, and this is described in the embodiment of FIG. 4. This gap dimension is the Dimension "c" illustrated in FIG. 4 which represents a relatively small displacement of the transition wall 50 or 52 from the commencement of the outer conductor transition. It has been found that by this displacement there is produced a VSWR of 1.02 which is an order of magnitude smaller than the VSWR of typical conductors of this type.

Although the tapered constriction in the outer conductor interlocking with the tapered recess in the insulator is sufficient to firmly locate these parts with respect to each other, over substantial temperature ranges, the same is not exactly true of the interlocking relationship between the insulator and the inner conductor. Generally speaking, the depth of the recesses 42 and 44 does not provide sufficient mechanical interlocking with the insulator to provide the desired stability in the relationship between the insulator and the inner conductor.

Thus, in order to maintain the desired stability with temperature, there is provided also a center recess or notch 40 which in the disclosed embodiment is preferably tapered and which interlocks with the insulator. Again, reference can be made to the previous descriptions relating to the tapered walls 50 and their coincidence at the point "P" to provide proper temperature compensation.

The recess 40 is cut sufficiently deep into the inner conductor so that it determines the relative location of the inner conductor with respect to the insulator as a function of temperature. This relatively short deep notch behaves like a shunt inductance which is placed between two short sections of the inner conductor, namely rings 46 and 48, whose radii are greater than that diameter of the inner conductor which was selected to give, in combination with the constricted outer conductor, the same characteristic impedance as the unconstricted line. The short sections (rings) of line act as shunt capacitances which match out the inductance contributed by the recess 40 between them. The final result then is a group of three recesses in the inner conductor dimensioned to match out the tapered constriction in the outer conductor. Again, the two outer recesses have outer edges which preferably fall outside of the tapered ends of the constriction in the outer conductor. Also, the inner diameter of the middle recess is less than the inner diameter of the recesses on either side thereof. In this regard, refer to Dimensions "d" and "e" in the aforementioned table and as identified in FIG. 4.

Thus, there is also provided a second mismatch at the center of the connector locking structure formed by the middle recess and associated rings which are added to the center conductor for locking purposes. As previously stated, the dimensions of the center groove or recess are determined by locking requirements. To provide proper matching, one must thus, basically vary the axial length of these rings. In this regard, it is basically the Dimension "h" represents the dimension that can be varied to in turn vary the respective widths of each of the rings. By experimentation, it was found that the dimension of 0.560 in this example provided an optimum VSWR of 1.025.

The axial length of the recess 40 provides a certain inherent inductance. The axial length of the rings represents a corresponding capacitance and if the respective inductance and capacitance are properly equalized, then the structure is matched. The deeper the recess at the center groove then the wider the rings have to be. Thus, the center recess functions as a shunt inductance while the rings themselves function as related capacitances and the structure together provides a proper match. The short sections of line at the rings act as shunt capacitances which match out the conductance contributed by the notch disposed therebetween.

As indicated previously, the interlocking between the connector parts is carried out by a temperature compensation technique that involves tapered walls or the like that converge to a common point. In other words, the opposed beveled end walls of the conductor and sleeve lie on surfaces of cones which each have a common vertex that is usually, but not necessarily, disposed on the connector axis. In the particular embodiment described in FIG. 4, it is noted that the diameter and length of each of the interlocking recesses are equal so that the beveled walls are at an angle of 45 degrees. Basically, the derivations described in my prior applications indicate that the following equation applies:

$$\text{Tan } \theta = \frac{L}{D}$$

As long as the converging walls follow this equation, then the parts remain in contact even over wide temperature ranges.

The above proof can be interpreted as follows. When the parts are constructed so that $L/D = \text{Tan } \theta$, lines drawn through the beveled ends of the ridge and the beveled ends of the groove intersect at a common point "P" on the axis of the parts and at the mid points of the ridge and the groove. If the point "P" is considered as the center of expansion for each part, then thermal expansion causes radial movement of any arbitrary point in the part with respect to the center of expansion. Points on the beveled ends of the ridge and the groove move radially in the direction of the beveled ends during a temperature change and thereby remain on the same radial line. This holds true for both parts, constructed of isotropic materials, regardless of differing coefficients of expansion. The important result is that the parts remain in contact at the beveled ends of the internal ridge and the groove and simply slide relative to each other over these angled surfaces during a temperature change, as illustrated in FIG. 1. Therefore, the parts remain in contact on these angled surfaces even though they do not remain in contact over their nonangled portions due to the differing coefficients of expansion. The connector thereby maintains mechanical contact and tight fit between parts over a temperature range in spite of differing coefficients of expansion.

Having now described a limited number of embodiments of the present invention, it should now be apparent to those skilled in the art that numerous other embodiments and modificants thereof are contemplated as falling within the scope of the present invention as defined by the appended claims.

What is claimed is:

1. In a coaxial connector having an outer conductor, an inner conductor, and an insulating member between said inner and outer conductors, said inner conductor having means defined therein axially disposed therealong forming three recesses including a middle recess and oppositely disposed remote recesses, and a pair of spaced rings disposed respectively between the middle recess and remote recesses, said rings each of a diameter greater than the middle recess diameter and dimensioned so that the connector is well matched over a broad frequency band and wherein the diameter of the middle recess is less than the diameter of the remote recesses.

2. In a coaxial connector as set forth in claim 1 wherein the middle recess is defined by tapered end walls transiting to respective rings.

3. In a coaxial connector as set forth in claim 1 wherein said rings each have an axial length less than the axial length of said middle recess.

4. In a coaxial connector as set forth in claim 1 wherein the inner conductor is continued beyond the remote recesses away from said rings at a diameter greater than the remote recess diameters.

5. In a coaxial connector as set forth in claim 4 wherein each recess is an annular groove in the inner conductor.

6. In a coaxial connector as set forth in claim 5 wherein the diameter of the remote recesses are the same.

7. In a coaxial connector having an outer conductor, an inner conductor, and an insulating member between said inner and outer conductors, said inner conductor having a recess formed thereon and a pair of spaced rings disposed one on each side of said recess, whereby said recess behaves as a shunt inductance between said rings and said rings act as shunt capacitances, said rings and recess being dimensioned so that the connector is well matched over a broad frequency band.

8. The coaxial connector of claim 7 wherein said inner conductor is further formed with a pair of remote recesses disposed one on the outward side of each of said rings.

9. In a coaxial connector as set forth in claim 8 wherein the recess located between said rings is defined by tapered end walls transiting to said respective rings.

10. In a coaxial connector as set forth in either of claims 7 or 8 wherein said rings each have an axial length less than the axial length of said recess which is located between said rings.

11. In a coaxial connector having an outer conductor, an inner conductor, and an insulating member between said inner and outer conductors, said inner conductor having means defined therein axially disposed therealong forming three recesses including a middle recess and oppositely disposed remote recesses, and a pair of spaced rings disposed respectively between the middle recess and remote recesses, said rings each of a diameter greater than the middle recess diameter and dimensioned so that the connector is well matched over a broad frequency band, wherein said outer conductor has means for interlocking with the insulating member including a constricting ridge of the outer conductor in combination with a recess in the insulating member, and wherein the outer conductor ridge as well as the inner conductor remote recesses have transitioning walls at the axial ends thereof.

12. In a coaxial connector as set forth in claim 11 wherein the transitioning walls at opposite ends of the inner conductor recesses are disposed axially and spacedly outside of the transitioning walls of the outer conductor.

13. In a coaxial connector as set forth in claim 12 wherein the transitioning walls of the outer conductor ridge are tapered, and the transitioning walls of the inner conductor middle recess are tapered.

14. In a coaxial connector as set forth in claim 13 wherein both the inner and outer conductor tapered transitioning walls are all extending to a common point.

15. In a coaxial connector as set forth in claim 13 wherein the tapered transitioning walls of the inner conductor middle recess extend to a common point.

16. In a coaxial connector having an outer conductor, an inner conductor, and an insulating member between said inner and outer conductors, said outer conductor having a section of reduced inner diameter formed with transition walls extending into said insulating member, and said inner conductor having means defined therein and axially disposed therealong providing recessed areas having transition walls to control any lowering of the impedance of the connector.

17. The coaxial connector of claim 16 wherein the transition walls of said inner conductor are located axially outward of the transition walls of said outer conductor.

18. In a coaxial connector according to either of claims 16 or 17 wherein said outer conductor transition walls are tapered surfaces that coverage to a point on the axis of the inner conductor.

19. In a coaxial connector according to either of claims 16 or 17 wherein said recess terminates in transitioning walls which are tapered surfaces that converge to a point on the axis of the inner conductor.

20. In a coaxial connector having an outer conductor, an inner conductor, and an insulating member between said inner and outer conductors, said inner conductor having means defined therein axially disposed therealong forming three recesses including a middle recess and oppositely disposed remote recesses, and a pair of spaced rings disposed respectively between the middle recess and remote recesses, wherein said outer conductor has means for interlocking with the insulating member including a constricting ridge of the outer conductor in combination with a recess in the insulating member, and wherein the middle recess is axially centrally located between the end of the constricting ridge.

* * * * *